US009494358B2

(12) United States Patent
Choi et al.

(10) Patent No.: US 9,494,358 B2
(45) Date of Patent: Nov. 15, 2016

(54) AIR CONDITIONER

(75) Inventors: Seokho Choi, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 244 days.

(21) Appl. No.: 14/350,468

(22) PCT Filed: Sep. 6, 2012

(86) PCT No.: PCT/KR2012/007181

§ 371 (c)(1),
(2), (4) Date: Apr. 8, 2014

(87) PCT Pub. No.: WO2013/055036

PCT Pub. Date: Apr. 18, 2013

(65) Prior Publication Data

US 2014/0245776 A1 Sep. 4, 2014

(30) Foreign Application Priority Data

Oct. 13, 2011 (KR) ..... 10-2011-0104457

(51) Int. Cl.

| | |
|---|---|
| ***F25B 39/04*** | (2006.01) |
| ***F25D 17/06*** | (2006.01) |
| ***F24F 1/38*** | (2011.01) |
| ***F24F 1/50*** | (2011.01) |

(52) U.S. Cl.

CPC ..... *F25D 17/06* (2013.01); *F24F 1/38* (2013.01); *F24F 1/50* (2013.01)

(58) Field of Classification Search

CPC ..... F25B 39/04; F25B 31/00; F25D 23/003; F24F 1/02; F24F 5/0017

USPC ..... 62/507, 428, 426

See application file for complete search history.

(56) References Cited

U.S. PATENT DOCUMENTS

| | | | | |
|---|---|---|---|---|
| 4,501,194 | A * | 2/1985 | Brown | F24F 7/025 454/354 |
| 6,074,182 | A * | 6/2000 | Matson | F04D 29/646 417/423.14 |
| 6,190,140 | B1 * | 2/2001 | Matson | F04D 25/08 417/362 |
| 2003/0021674 | A1 | 1/2003 | Zeighami et al. | |
| 2009/0226299 | A1 | 9/2009 | Jin | |
| 2011/0174011 | A1 | 7/2011 | Kim et al. | |

FOREIGN PATENT DOCUMENTS

| | | |
|---|---|---|
| CN | 1319165 | 10/2001 |
| CN | 2508031 | 8/2002 |
| CN | 2713188 | 7/2005 |
| CN | 101315082 | 12/2008 |
| CN | 101331362 | 12/2008 |
| CN | 201953719 | 8/2011 |

(Continued)

OTHER PUBLICATIONS

International Search Report dated Jan. 25, 2013 issued in Application No. PCT/KR2012/007181.

(Continued)

*Primary Examiner* — Melvin Jones

(74) *Attorney, Agent, or Firm* — KED & Associates, LLP

(57) ABSTRACT

An air conditioner is provided, which can reduce a rotation direction velocity component of air being discharged from a fan and enhance fan efficiency and installed space utilization.

18 Claims, 7 Drawing Sheets

(56) References Cited

FOREIGN PATENT DOCUMENTS

| | | | |
|---|---|---|---|
| EP | 2 206 976 | A2 | 7/2010 |
| JP | 08-257457 | | 10/1996 |
| JP | 09-060927 | A | 3/1997 |
| JP | 2001-124359 | A | 5/2001 |
| JP | 2002-317972 | A | 10/2002 |
| JP | 2003-113799 | | 4/2003 |
| JP | 2007-263436 | A | 10/2007 |
| JP | 2008-261280 | | 10/2008 |
| KR | 10-2010-0102787 | | 9/2010 |
| WO | WO 2007/148645 | A1 | 12/2007 |

OTHER PUBLICATIONS

Korean Notice of Allowance dated Jan. 24, 2013 (translation).
Chinese Office Action dated Dec. 3, 2015 (English Translation).
European Search Report dated Jun. 5, 2015 issued in Application No. 12840462.1.

* cited by examiner

AIR CONDITIONER

CROSS-REFERENCE TO RELATED PATENT APPLICATIONS

This application is a U.S. National Stage Application under 35 U.S.C. §371 of PCT Application No. PCT/KR2012/007181, filed Sep. 6, 2012, which claims priority to Korean Patent Application No. 10-2011-0104457, filed Oct. 13, 2011.

TECHNICAL FIELD

The present invention relates to air conditioners, and more particularly, to an air conditioner which can enhance fan efficiency and installed space utilization.

BACKGROUND ART

In general, the air conditioner is provided with a refrigerating cycle including a compressor, an outdoor heat exchanger, an expansion valve, and an indoor heat exchanger, basically. In detail, in the refrigerating cycle, gaseous refrigerant compressed at the compressor is introduced to the outdoor heat exchanger and involved in a phase change from the gaseous refrigerant to liquid refrigerant while discharging heat to an outside of the outdoor heat exchanger. Then, the liquid refrigerant from the outdoor heat exchanger is expanded while passing through the expansion valve, and, therefrom, introduced to the indoor heat exchanger.

Then, the refrigerant introduced to the indoor heat exchanger is involved in a phase change from the liquid refrigerant to the gaseous refrigerant. A likely, the refrigerant absorbs heat from an outside of the indoor heat exchanger while the refrigerant is involved in a phase change.

And, the air conditioner may be provided with an outdoor unit installed in an outdoor space and an indoor unit installed in a room space. The outdoor unit may have the compressor for compressing the refrigerant, the outdoor heat exchanger and the fan for heat exchange of the refrigerant with outdoor air, and various kinds of pipelines for connecting the compressor to the indoor unit. The indoor unit may have the indoor heat exchanger and the expansion valve for heat exchange of the refrigerant with room air.

In the meantime, the outdoor unit with a plurality of the indoor units connected thereto has a large sized outdoor heat exchanger mounted thereto for increasing a heat exchanger area, a compressor, an oil separator, and an accumulator for the refrigerant circulating an air conditioning cycle, a fan for forced flow of the air and a motor for rotation of the fan mounted thereto, and a plurality of pipelines for connection among different elements and the indoor unit housed in the outdoor unit.

FIG. 1 illustrates a conceptual drawing of a velocity triangle of an axial flow fan mounted to an outdoor unit of a related art air conditioner.

Referring to FIG. 1, W1 denotes a relative velocity of air being introduced to the axial flow fan 10, W2 denotes a relative velocity of the air being discharged from the axial flow fan 10, u denotes a rotation velocity of a blade of the axial flow fan, V1 denotes an absolute velocity of the air being introduced to the fan, V2 denotes an absolute velocity of the air being discharged from the fan, Vm2 denotes an axial velocity component of the axial flow fan 10, and β1 and β2 denote an inlet angle and an outlet angle of the blade 11, respectively.

The axial flow fan produces an axial flow A, and, in a velocity component u of the air being discharged from the axial flow fan 10, a ratational velocity component Vu2 produced by rotation of the axial flow fan 10 in a rotation direction thereof is a loss produced without relation to work of the axial flow fan 10, which drops efficiency of the axial flow fan 10.

DISCLOSURE OF INVENTION

Technical Problem

To solve the problems, an object of the present invention is to provide an air conditioner which can enhance fan efficiency and utilization of an installed space.

Solution to Problem

To achieve these objects and other advantages and in accordance with the purpose of the invention, as embodied and broadly described herein, an air conditioner includes a housing having an air inlet and an air outlet, a compressor disposed in the housing, a heat exchanger disposed in the housing, a fan for discharging air introduced through the air inlet through the air outlet, a motor mounted in the housing for rotating the fan, and an inlet flow path guide for giving a velocity component to the air being introduced to the fan in a direction opposite to a direction of a ratational velocity component of the air produced by rotation of the fan.

And, the inlet flow path guide may include a plurality of vanes.

And, the vane may be tilted in a direction opposite to a rotation direction of the fan.

And, the vane may be tilted in a direction the same with a blade of the fan.

And, the vane may have a shape of a streamline, a straight line, or a combination of the streamline and the straight line.

And, the vane may have an inlet edge with a slope angle from an axis of the fan formed smaller than a slope angle of an outlet edge thereof.

And, the housing may include a motor mounting portion provided thereto for mounting the motor thereto.

And, the inlet flow path guide may include a supporting member mounted to the motor mounting portion, and the vane may be provided to the supporting member.

And, the motor mounting portion may include a plurality of bars spaced at fixed intervals, and the supporting member is fixedly secured to the bar such that the vanes are positioned in a radial direction of the fan.

And, the inlet flow path guide may include a hub mounted to a lower portion of the motor, and the vanes are provided on an outside circumference of the hub in a circumferential direction of the fan.

In another aspect of the present invention, an air conditioner includes a housing having an air inlet and an air outlet, a compressor disposed in the housing, a heat exchanger disposed in the housing, a fan for discharging air introduced through the air inlet through the air outlet, a motor mounted in the housing for rotating the fan, and an outlet flow path guide for giving a velocity component to the air being discharged from the fan in a direction opposite to a direction of a ratational velocity component of the air produced by rotation of the fan.

And, the outlet flow path guide may include a plurality of vanes.

And, the vane may be tilted in a rotation direction of the fan.

And, the vane may be tilted in a direction opposite to a tilt of a blade of the fan.

And, the vane may have a shape of a streamline, a straight line, or a combination of the streamline and the straight line.

And, the vane may have an inlet edge with a slope angle from an axis of the fan formed larger than a slope angle of an outlet edge thereof.

And, the air conditioner may further include an outlet grill mounted to an air outlet of the housing, and the outlet flow path guide is arranged in a space between the outlet grill and the fan.

And, the outlet flow path guide may include a mounting member, and a plurality of vanes provided to an outside circumference of the mounting member tilted in a rotation direction of the fan.

And, the air conditioner may further include an outlet grill mounted to an air outlet of the housing, and the outlet flow path guide is formed as one unit with the outlet grill.

And, the outlet grill includes a plurality of ribs extended in a radial direction of the fan, and the rib is tilted in a rotation direction of the fan.

Advantageous Effects of Invention

The air conditioner of the present invention has high fan efficiency and installation space utilization.

BRIEF DESCRIPTION OF DRAWINGS

The above and other aspects, features, and advantages of the present invention will become more apparent upon consideration of the following description of preferred embodiments, taken in conjunction with the accompanying drawing figures.

BEST MODE FOR CARRYING OUT THE INVENTION

Figure 1:
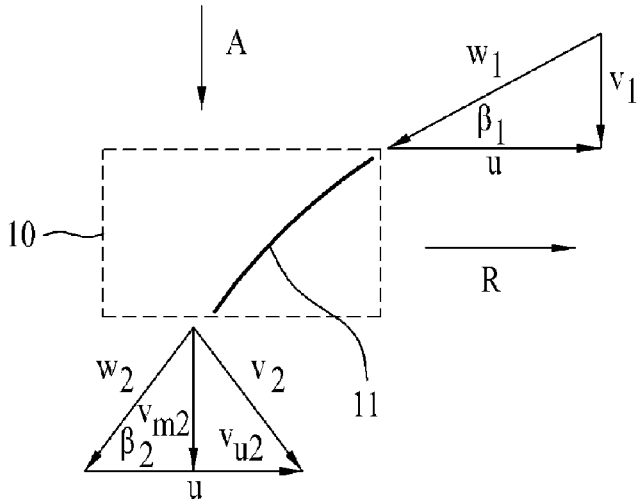
FIG. 1 illustrates a conceptual drawing of a velocity triangle of an axial flow fan mounted to an outdoor unit of a related art air conditioner.

An air conditioner in accordance with a preferred embodiment of the present invention will be described with reference to the attached drawings. The attached drawings illustrate exemplary modes of the present invention, provided for describing the present invention in more detail, but not for limiting technical scopes of the present invention.

And, regardless of drawing numbers, identical or corresponding elements will be given the same reference numbers, and repetitive description of which will be omitted. For convenience of description, a size or a shape of an element may be exaggerated or reduced.

In the meantime, though terms including ordinal numbers, such as first or second, can be used for describing various elements, the elements are not confined by the terms, and are used only for making one element distinctive from other elements.

The air conditioner related to a preferred embodiment of the present invention includes a housing 110 having an air inlet and an air outlet, a compressor 130 disposed in the housing 110, a heat exchanger 120 disposed in the housing 110, a fan 140 for discharging air introduced through the air inlet through the air outlet, a motor 150 mounted in the housing 110 for rotating the fan 140, and at least one flow path guide 200 and 300 for giving a velocity component in a direction opposite to a ratational velocity component to the air being discharged from the fan 140 to reduce a ratational direction velocity component of the air being discharged from the fan 140.

As a first embodiment, the flow path guide may be an inlet flow path guide 200 for giving a velocity component in a direction opposite to a ratational velocity component produced by rotation of the fan to the air being introduced to the fan. The inlet flow path guide 200 performs a function for giving the velocity component in a direction opposite to the ratational velocity component produced by the fan to the air before introduced to the fan.

As a second embodiment, the flow path guide may be an outlet flow path guide 300 for giving a velocity component in a direction opposite to a ratational velocity component produced by rotation of the fan to the air being discharged from the fan. The outlet flow path guide 300 performs a function for giving the velocity component in a direction opposite to the ratational velocity component produced by the fan to the air being discharged from the fan.

Air conditioners related to first and second embodiments of the present invention will be described with reference to the attached drawing in detail, respectively.

Figure 2:
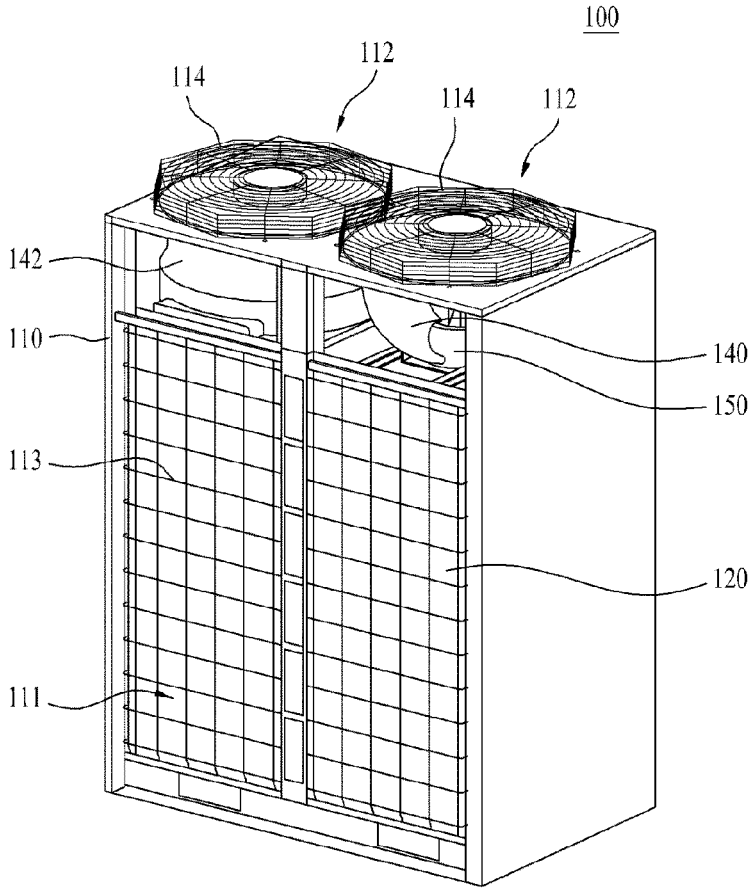
FIG. 2 illustrates a perspective view of an air conditioner related to a preferred embodiment of the present invention.
Figure 3:
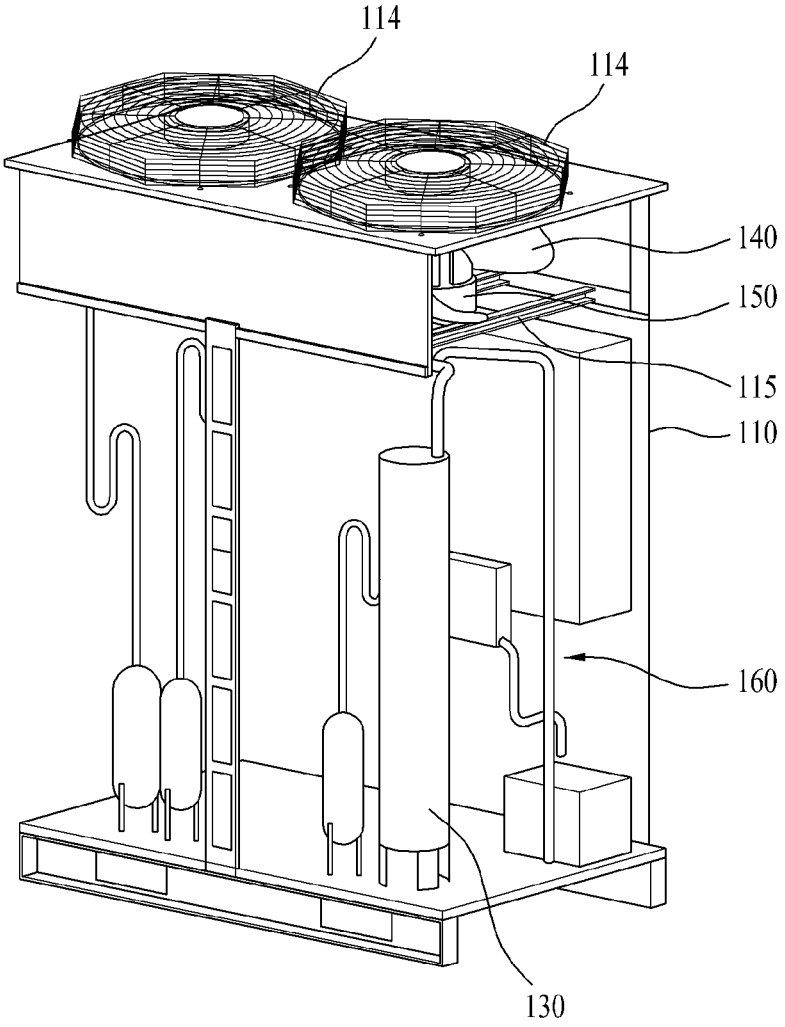
FIG. 3 illustrates a perspective view of the air conditioner in FIG. 2, showing an inside thereof.
Figure 4:
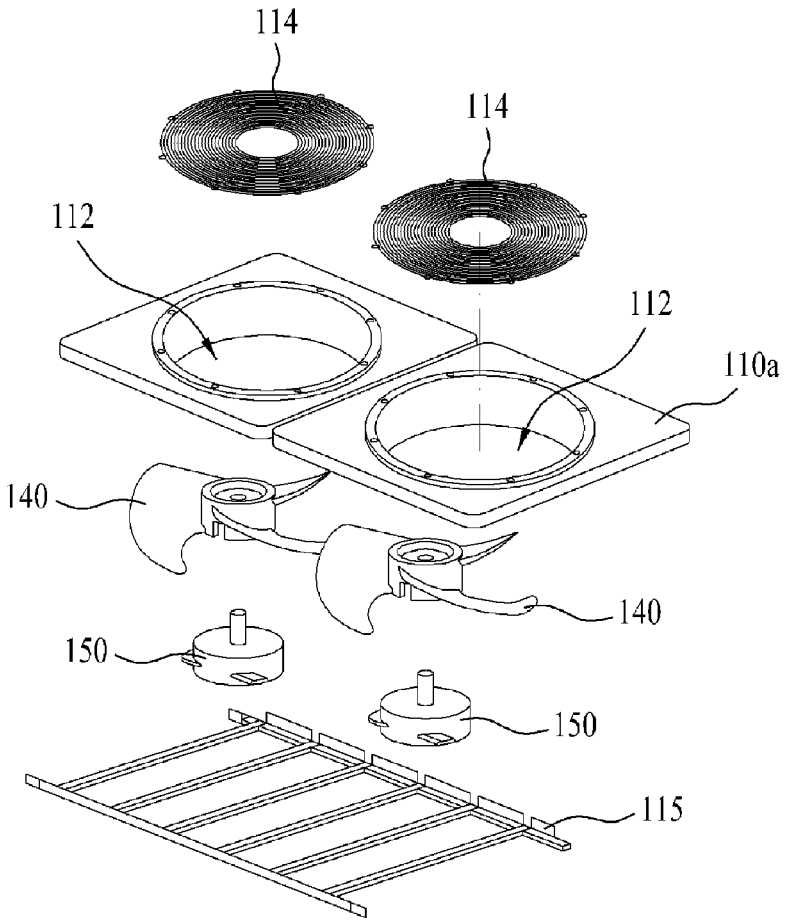
FIG. 4 illustrates an exploded perspective view of key elements of the air conditioner in FIG. 2.

FIG. 2 illustrates a perspective view of an air conditioner related to a preferred embodiment of the present invention, FIG. 3 illustrates a perspective view of the air conditioner in FIG. 2, showing an inside thereof, and FIG. 4 illustrates an exploded perspective view of key elements of the air conditioner in FIG. 2.

Elements of the air conditioner related to the preferred embodiment of the present invention will be described.

Referring to FIGS. 2 and 3, the air conditioner may include an outdoor unit 100 installed to an outdoor space, and an indoor unit (Not shown) installed to a room space. The air conditioner may be used as a meaning of indicating the outdoor unit 100, only. Hereinafter, for convenience of description, the air conditioner indicates the outdoor unit 100, only.

The outdoor unit 100 includes a housing 110 which forms an exterior appearance of the outdoor unit 100, an outdoor heat exchanger 120 (Hereafter called as "heat exchanger") for heat exchange of refrigerant with outdoor air, a compressor 130 for compressing the refrigerant, a fan 140, a motor 150 for rotating the fan 140, and various kinds of pipelines 160 for flow of the refrigerant.

And, the indoor unit may include an indoor heat exchanger for heat exchange of the room air with the refrigerant, and an expansion valve. For convenience of description, FIGS. 2 and 3 illustrate the outdoor units of the air conditioners only, respectively.

The housing 110 has an air inlet 111 and an air outlet 112. The air inlet 111 may be formed in one side (For an example, a front side) of the housing 110, and the air outlet 112 may be formed in a top side of the housing 110. The air inlet 111 and the air outlet 112 in the housing 110 may have an inlet grill 113 and an outlet grill 114 mounted thereto, respectively. The air inlet 111 may have at least one filter (Not shown) provided thereto for cleaning the air being introduced thereto.

Moreover, the housing 110 may have a polyhedron shape, with a plurality of side frames, a top frame 110*a* and a bottom frame, each formed by assembly or as one unit.

Mounted in the housing 110, there may be the heat exchanger 120, the compressor 130 for compressing the refrigerant which circulates a refrigerating cycle, an oil separator (No reference number) mounted to an outlet side of the compressor 130 for separating oil from the refrigerant to recover the refrigerant to the compressor again, and an accumulator (No reference number) provided to an inlet side of the compressor 130 for separating liquid refrigerant to introduce only gaseous refrigerant to the compressor.

Moreover, the housing 110 may have a four-way valve mounted therein for changing a flow direction of the refrigerant according to a room cooling/heating mode change, and a plurality of pipelines 160 for connecting elements and the indoor unit.

For making a heat exchange area large, the heat exchanger 120 may be disposed to a side of the air inlet 111 of the housing 110, and the motor 150 may be disposed to a side of the air outlet 112 of the housing.

Referring to FIG. 4, the housing 110 may have a motor mounting portion 115 provided thereto for mounting the motor 150 thereon. The motor mounting portion 115 may be mounted to a side of the air outlet 112 in the housing 110, to include a plurality of bars spaced at fixed intervals to have an "H" shape or a ladder shape.

The motor 150 is fixedly secured to the motor mounting portion 115. For an example, the motor 150 may have one pair of mounting brackets (No reference number) on a lower side of the motor 150.

Referring to FIGS. 3 and 4, the fan 140 may be an axial flow fan mounted to the motor 150 for producing an axial flow, and may have a shroud 142 surrounding the fan 140. And, an outlet grill 114 may be mounted to a top frame 110*a* of the housing 110. The embodiment will be described confining the fan 140 to an axial flow fan.

With reference to the motor mounting portion 115, the motor 150 and the fan 140 are disposed in an upper space of the housing 110, and the compressor 130 and the various pipelines 160 are disposed in a lower space. And, in order to reduce a whole size and improve space utilization, various elements are arranged close to one another in the lower space of the housing 110, and the heat exchanger 120 is arranged at a periphery of the housing 110.

Figure 5:
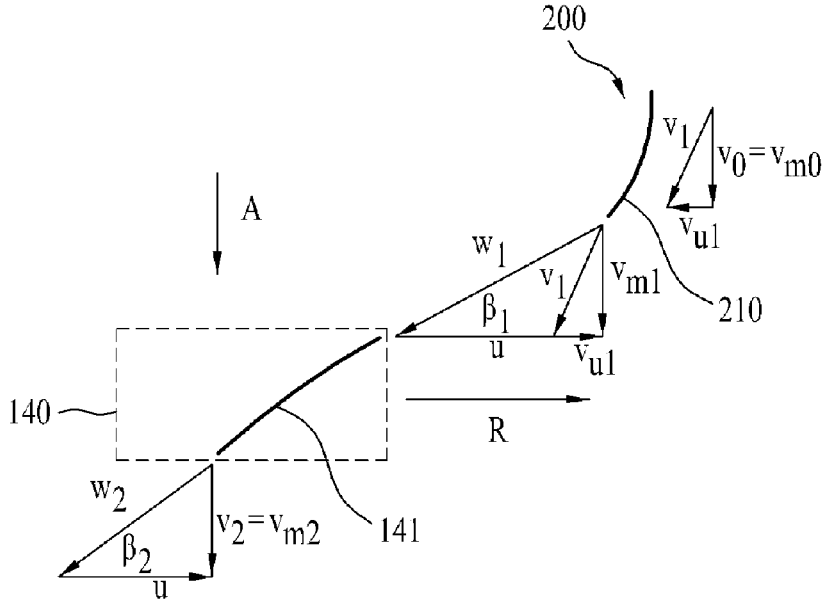
FIG. 5 illustrates a conceptual drawing for explaining an operation state of an inlet flow path guide of an air conditioner related to a first preferred embodiment of the present invention.

FIG. 5 illustrates a conceptual drawing for explaining an operation state of an inlet flow path guide of an air conditioner related to a first preferred embodiment of the present invention.

As described with reference to FIG. 1, in the velocity component u of the air being discharged from the axial flow fan 10, the ratational velocity component Vu2 produced by rotation of the axial flow fan 10 corresponds to a loss produced without relation to work of the axial flow fan, which drops efficiency of the axial flow fan 10.

The air conditioner 100 related to a first preferred embodiment of the present invention includes an inlet flow path guide 200 for giving a velocity component opposite to a direction of the ratational velocity component u produced by rotation of the fan 140 to the air being introduced to the fan 140.

In the meantime, unexplained reference symbol A denotes an axial direction of the fan, R denotes a rotation direction of the fan.

Referring to FIG. 5, W1 denotes a relative velocity of air being introduced to the axial flow fan, W2 denotes a relative velocity of the air being discharged from the axial flow fan, u denotes a rotation velocity of a blade 141 of the axial flow fan 140, V1 denotes an absolute velocity of the air being introduced to the axial flow fan 140, and V2 denotes an absolute velocity of the air being discharged from the axial flow fan 140.

And, Vm1 denotes an axial velocity component of the air being introduced to the axial flow fan, Vm2 denotes an axial velocity component of the air being discharged from the axial flow fan, and $\beta 1$ and $\beta 2$ denote an inlet angle and an outlet angle of the blade, respectively.

The inlet flow path guide 200 may include a plurality of vanes 210 for producing a particular direction flow of the air being introduced to the axial flow fan 140.

In this instance, it is preferable that the vane 210 is tilted in a direction opposite to the rotation direction R of the axial flow fan 140 for giving a velocity component Vu1 in a direction opposite to a direction of a ratational velocity component u produced by rotation of the axial flow fan 140 to the air being introduced to the axial flow fan 140.

In detail, the vane 210 may be tilted in a direction the same with the blade 141 of the axial flow fan 140, with a slope angle of an inlet edge of the vane 210 from an axis of the axial flow fan 140 formed smaller than a slope angle of an outlet edge of the vane 210 from the axis of the axial flow fan 140.

Moreover, the vane 210 may have a streamline shape, a straight line shape, or a combination of the streamline shape and the straight line shape.

Referring to a velocity triangle of the axial flow fan 140 in FIG. 5, the air passed through the inlet flow path guide 200 is made to have the velocity component Vu1 in a direction opposite to a direction of the ratational velocity component u produced by rotation of the axial flow fan 140 by the vane 210.

Thereafter, an absolute velocity V2 of the air discharged from the axial flow fan 140 has an axial velocity component Vm2, only.

As has been described, the air conditioner 100 related to a preferred embodiment of the present invention can enhance efficiency of the axial flow fan 140 owing to erasure of the ratational velocity component Vu2 (See FIG. 1) come from rotation of the axial flow fan 140 from a discharge flow of the axial flow fan 140 with the velocity component in a direction opposite to a rotation direction of the axial flow fan 140, which is increased with the inlet flow path guide 200 mounted to the air inlet side of the axial flow fan 140.

A mounting structure of the inlet flow path guide 200 in the housing 100 will be described, with reference to the attached drawings, in detail.

Figure 6:
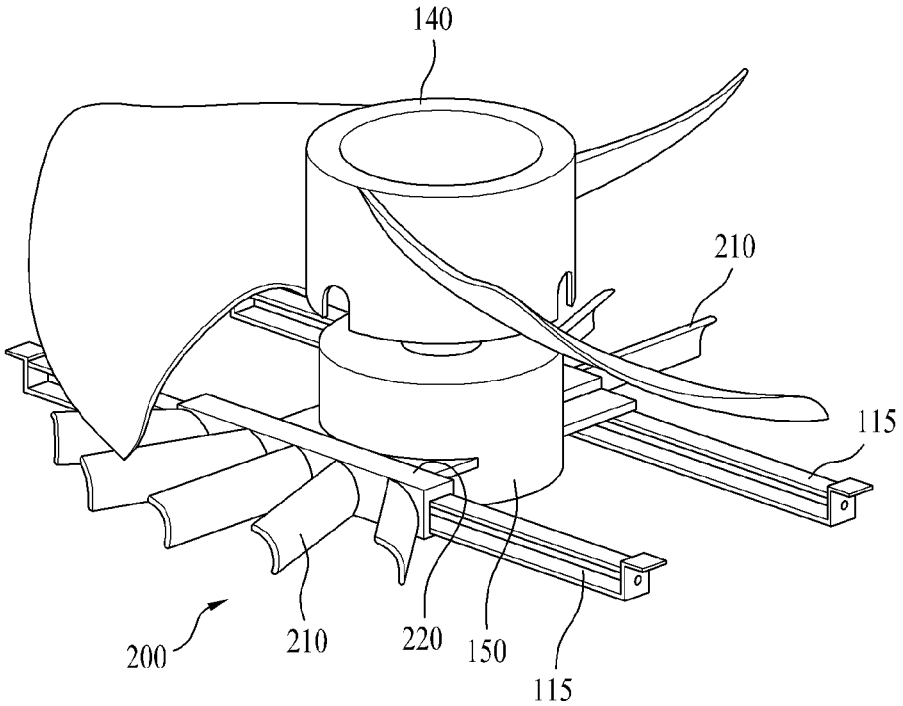
FIGS. 6 and 7 illustrate perspective views of key elements each for explaining an operation state of an inlet flow path guide of an air conditioner related to a first preferred embodiment of the present invention.
Figure 7:
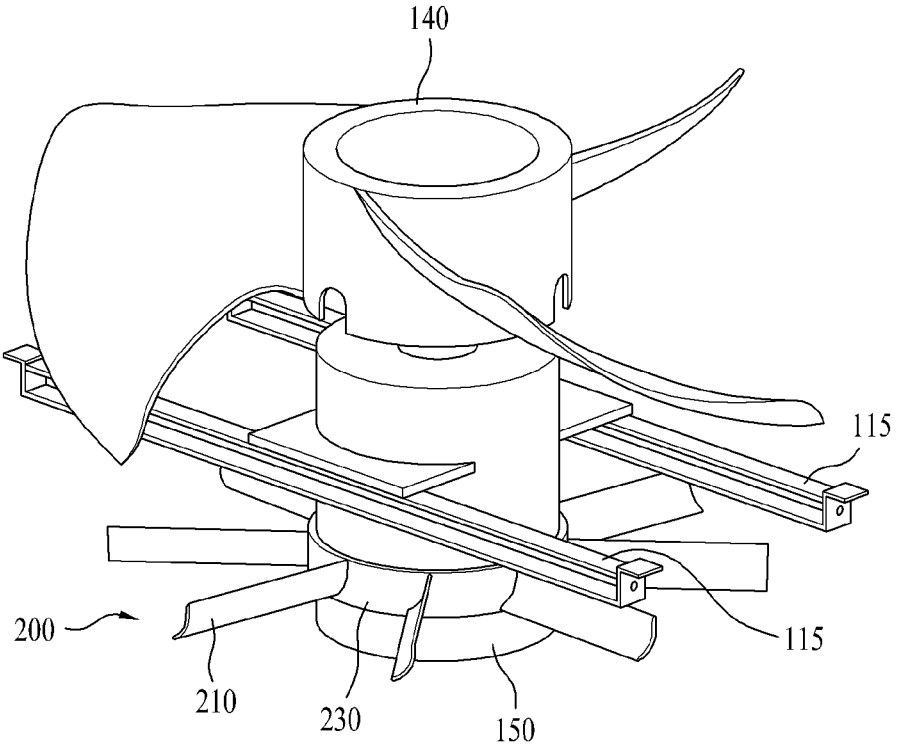

FIGS. 6 and 7 illustrate perspective views of key elements each for explaining an operation state of an inlet flow path guide of an air conditioner related to a first preferred embodiment of the present invention.

As described before, it is preferable that the inlet flow path guide 200 is arranged on an inlet side of the axial flow fan 140. And, various elements are arranged close to one another in the lower space of the housing 110 with reference to the motor mounting portion 115, and the heat exchanger 120 is arranged at a periphery of the housing 110.

As one embodiment, the inlet flow path guide 200 may be mounted to the motor mounting portion 115.

Referring to FIG. 6, the inlet flow path guide 200 may include a supporting member 220 mounted to the motor mounting portion 115, with the vane 210 may be mounted to the supporting member 220. As described before, the motor mounting portion 115 may include a plurality of bars spaced at fixed intervals, and the supporting member 220 may be fixedly secured to the bar such that the vanes 210 are positioned in a radial direction of the axial flow fan 140.

And, the supporting member 220 may have a bar shape, and, in order to reduce work man-hours, the motor 140 and the supporting member 220 may be fastened to the motor mounting portion 115, altogether. A number and a size of the vanes 210 may vary with a capacity of the axial flow fan 140.

In such a structure, the velocity component produced to an inlet flow of the axial flow fan 140 in a direction opposite to a direction of rotation of the axial flow fan 140 in a course the inlet flow passes through the inlet flow path guide 200 owing to the inlet flow path guide 200 positioned on the air inlet side of the axial flow fan 140 erases the ratational velocity component Vu2 (See FIG. 1) caused by the rotation of the axial flow fan 140 from the outlet flow of the axial flow fan 140.

And, the mounting of the inlet flow path guide 200 to the motor mounting portion 115 which exists presently for mounting the motor 150 without providing a separate bracket permits to enhance space utilization of an inside of the housing 110 and reduce production cost.

Different from this, referring to FIG. 7, the inlet flow path guide 200 may be mounted to the motor 150, and, specifically, to a lower portion of the motor 150.

The inlet flow path guide 200 may include a hub 230 mounted to the lower portion of the motor 150, and the hub 230 may have a ring shape inserted on, fastened or welded to the lower portion.

The vane 210 may be plural provided on an outside circumference of the hub 230 in a circumferential direction of the axial flow fan 140.

In such a structure, the velocity component produced to an inlet flow of the axial flow fan 140 in a direction opposite to a direction of rotation of the axial flow fan 140 in a course the inlet flow passes through the inlet flow path guide 200 owing to the inlet flow path guide 200 positioned on the air inlet side of the axial flow fan 140 erases the ratational velocity component Vu2 (See FIG. 1) caused by the rotation of the axial flow fan 140 from the outlet flow of the axial flow fan 140.

And, the mounting of the inlet flow path guide 200 to the lower portion of the motor 150 without providing a separate bracket permits to enhance space utilization of an inside of the housing 110 and reduce production cost.

Figure 8:
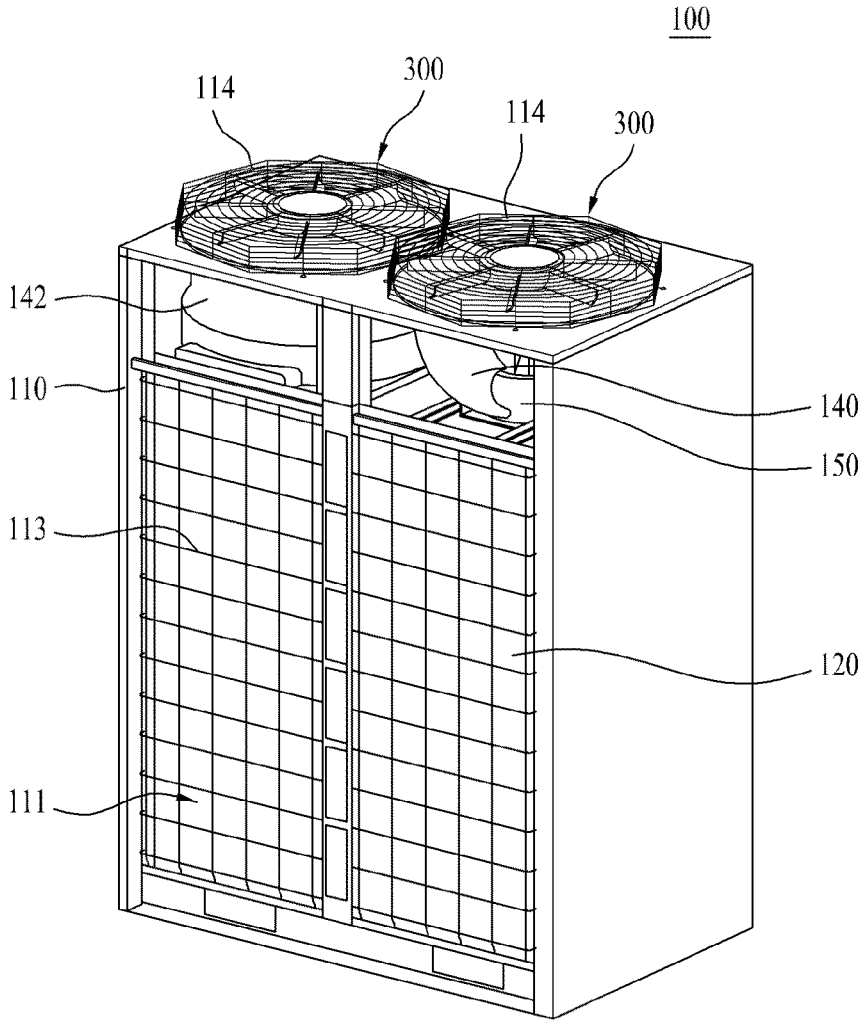
FIG. 8 illustrates a perspective view of an air conditioner related to a second preferred embodiment of the present invention.
Figure 9:
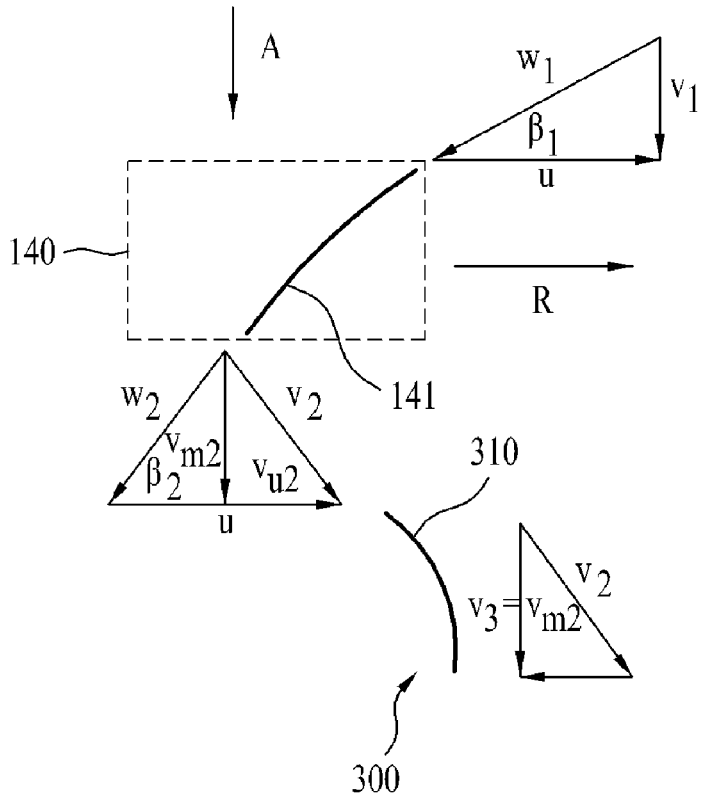
FIG. 9 illustrates a conceptual drawing for explaining an operation state of an outlet flow path guide of an air conditioner related to a second preferred embodiment of the present invention.

FIG. 8 illustrates a perspective view of an air conditioner related to a second preferred embodiment of the present invention, and FIG. 9 illustrates a conceptual drawing for explaining an operation state of an outlet flow path guide of an air conditioner related to a second preferred embodiment of the present invention.

The air conditioner related to a second preferred embodiment of the present invention has a difference from the first preferred embodiment in an outlet flow path guide. Since structures of the housing 110, the compressor 130, the heat exchanger 120, the motor 150, the motor mounting portion 115, and the fan 140 are the same with ones of the first embodiment, detailed description of the same will be omitted.

In the meantime, as described with reference to FIG. 1, in a velocity component u of the air being discharged from the axial flow fan 10, a ratational velocity component Vu2 produced by rotation of the axial flow fan 10 is a loss produced without relation to work of the axial flow fan 10, which drops efficiency of the axial flow fan 10.

The air conditioner 100 related to a second preferred embodiment of the present invention includes an outlet flow path guide 300 for giving a velocity component Vu1 opposite to a direction of a ratational velocity component u produced by rotation of the fan 140 to the air being discharged from the fan 140.

Referring to FIG. 9, W1 denotes a relative velocity of air being introduced to the axial flow fan, W2 denotes a relative velocity of the air being discharged from the axial flow fan, u denotes a rotation velocity of a blade 141 of the axial flow fan 140, V1 denotes an absolute velocity of the air being introduced to the axial flow fan 140, V2 denotes an absolute velocity of the air being discharged from the axial flow fan 140, and V3 denotes an absolute velocity of the air being discharged from the outlet flow path guide 300.

And, Vm2 denotes an axial velocity component of the air being discharged from the axial flow fan, and $\beta 1$ and $\beta 2$ denote an inlet angle and an outlet angle of the blade, respectively.

The outlet flow path guide 300 may include a plurality of vanes 310 for producing a particular direction flow of the air being discharged from the axial flow fan 140.

In this instance, it is preferable that the vane 310 is tilted in a rotation direction of the axial flow fan 140 for giving a velocity component Vu3 in a direction opposite to a direction of the ratational velocity component u produced by rotation of the axial flow fan 140 to the air being discharged from the axial flow fan 140.

In detail, the vane 310 may be tilted in a direction opposite to a tilt of the blade 141 of the axial flow fan 140, with a slope angle of an inlet edge of the vane 310 from an axis of the axial flow fan 140 formed larger than a slope angle of an outlet edge of the vane 310 from the axis of the axial flow fan 140.

The vane 310 may have a streamline shape, a straight line shape, or a combination of the streamline shape and the straight line shape.

Referring to a velocity triangle of the axial flow fan 140 in FIG. 9, the velocity component Vu3 in a direction opposite to a direction of the ratational velocity component u produced by rotation of the axial flow fan 140 is given to the air passed through the outlet flow path guide 300 in a course the air passes through the vane 310.

Thereafter, the air passed through the outlet flow path guide 300 has a velocity V3 the same with an axial velocity component Vm2 of an absolute velocity V2 of the air discharged from the axial flow fan 140.

As has been described, the air conditioner 100 related to a second preferred embodiment of the present invention can enhance efficiency of the axial flow fan 140 owing to erasure of the ratational velocity component Vu2 come from rotation of the axial flow fan 140 from a discharge flow of the axial flow fan 140 with the velocity component in a direction opposite to a rotation direction of the axial flow fan 140, which is increased with the outlet flow path guide 300 mounted to the air outlet side of the axial flow fan 140.

A mounting structure of the outlet flow path guide 300 in the housing 100 will be described, with reference to the attached drawings, in detail.

Figure 10:
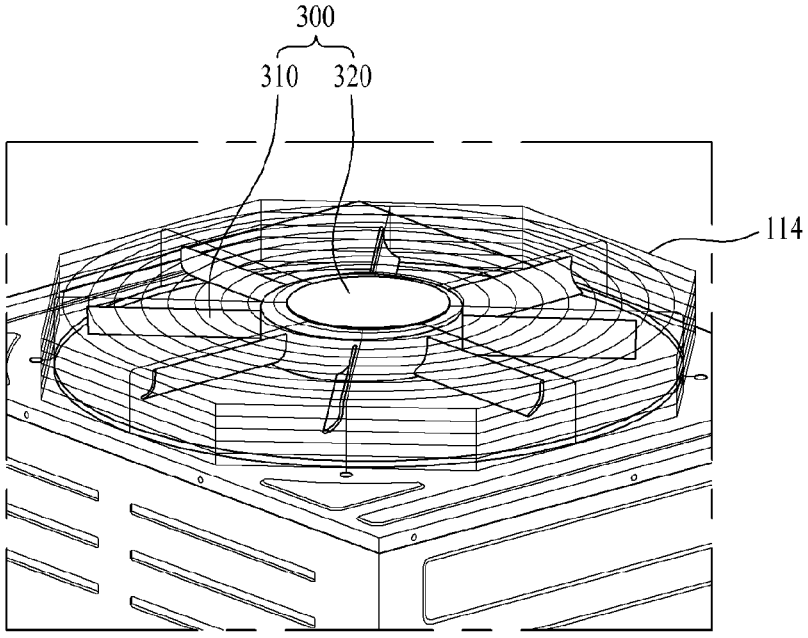
FIGS. 10 and 11 illustrate perspective views of key elements each for explaining an operation state of an outlet flow path guide of an air conditioner related to a second preferred embodiment of the present invention.
Figure 11:
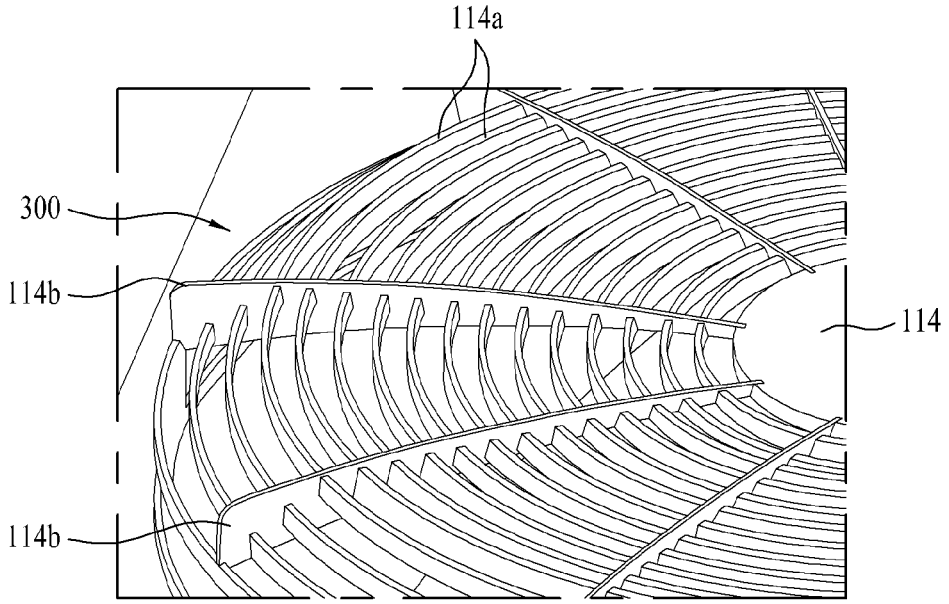

FIGS. 10 and 11 illustrate perspective views of key elements each for explaining an operation state of an outlet flow path guide of an air conditioner related to a second preferred embodiment of the present invention.

As described before, it is preferable that the outlet flow path guide 300 is arranged on an outlet side of the axial flow fan 140. And, with reference to the motor mounting portion 115, various elements are arranged close to one another in a lower space of the housing 110, and the heat exchanger 120 is arranged at a periphery of the housing 110, and the motor 150, the axial flow fan 150, the top frame 110*a*, and the outlet grill 114 are arranged in an upper space of the housing 110.

As one embodiment, the outlet flow path guide 300 may be mounted in a space between the axial flow fan 140 and the outlet grill 114.

Referring to FIG. 10, the outlet flow path guide 300 may include a mounting member 320 mounted to the axial flow fan 140 or the outlet grill 114, and a plurality of the vanes 310 provided to an outside circumference of the mounting member 320 tilted in a rotation direction of the axial flow fan 140.

And, as described before, the vane 310 may be tilted in a direction opposite to a tilt of the blade 141 of the axial flow fan 140, with a slope angle of an inlet edge of the vane 310 from an axis of the axial flow fan 140 formed larger than a slope angle of an outlet edge of the vane 310 from the axis of the axial flow fan 140, and the vane 310 may have a streamline shape, a straight line shape, or a combination of the streamline shape and the straight line shape.

The mounting member 320 may have a cylindrical or a ring shape, and the mounting member 320 may be fixedly secured to a top side of the outlet grill 114 or the axial flow fan 140 to position the mounting member 300 within an inside space of the outlet grill 114.

And, a number and a size of the vanes 310 provided to the mounting member 320 may vary with a capacity of the fan 140.

In such a structure, the velocity component given to an outlet flow of the axial flow fan 140 in a direction opposite to a direction of rotation of the axial flow fan 140 in a course the outlet flow passes through the outlet flow path guide 300 makes the ratational velocity component Vu2 come from rotation of the axial flow fan 140 to disappear from the outlet flow of the axial flow fan 140.

And, the mounting of the outlet flow path guide 300 to a top side of the fan 140 or an inside circumference of the outlet grill 114 without providing a separate bracket permits to enhance space utilization of an inside of the housing 110 and reduce production cost.

Different from this, referring to FIG. 11, the outlet flow path guide 300 may be formed as one unit with the outlet grill 114.

The outlet grill 114 may have a variety of shapes. For an example, the outlet grill 114 may include ring members 114*a* of different diameters, and a plurality of ribs 114*b* extended in a direction of passing through the ring members adjacent to each other, i.e., a radial direction.

In this case, the rib 114*b* may be formed to perform a function the same with the vane 310 in the outlet flow path guide 300. In detail, the rib 114*b* may be tilted in a rotation direction of the axial flow fan 140, may be tilted in a direction opposite to a tilt of the blade 141 of the axial flow fan 140 from an axis of the axial flow fan 140, may have a slope angle of an inlet edge thereof from the axis of the axial flow fan 140 formed larger than a slope angle of an outlet edge thereof, and may have a shape of a streamline, a straight line, or a combination of the streamline and the straight line.

In such a structure, a velocity component given to an outlet flow of the axial flow fan 140 in a direction opposite to a direction of rotation of the axial flow fan 140 in a course the outlet flow passes through the outlet flow path guide 300 makes a ratational velocity component Vu2 come from rotation of the axial flow fan 140 to disappear from the outlet flow of the axial flow fan 140.

Moreover, since the outlet flow path guide 300 is formed as one unit with the outlet grill 114 at one region thereof (For an example, the ribs) without using a separate bracket, the air conditioner of the present invention can enhance space utilization of an inside of the housing 110 and can reduce production cost.

As has been described, the air conditioner of the present invention can enhance efficiency of the fan and installation space utilization.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and appended claims. In addition to variations and modifications in the component parts and/or arrangements, alternative uses will also be apparent to those skilled in the art.

The invention claimed is:

1. An air conditioner comprising:

a housing having an air inlet and an air outlet;

a compressor provided in the housing;

a heat exchanger provided in the housing;

a fan that discharges air introduced through the air inlet out through the air outlet;

a motor mounted in the housing to rotate the fan; and an inlet flow path guide that provides a velocity component to the air being introduced to the fan in a direction opposite to a direction of a rotational velocity component of the air produced by rotation of the fan, wherein the inlet flow path guide includes a plurality of vanes, and at least one vane of the plurality of vanes is tilted in a direction opposite to a rotation direction of the fan.

2. The air conditioner as claimed in claim 1, wherein the at least one vane is tilted in a direction the same as a direction of a blade of the fan.

3. The air conditioner as claimed in claim 2, wherein the at least one vane has a shape of a streamline, a straight line, or a combination of the streamline and the straight line.

4. The air conditioner as claimed in claim 1, wherein the at least one vane has an inlet edge with a slope angle from an axis of the fan formed smaller than a slope angle of an outlet edge thereof.

5. The air conditioner as claimed in claim UM, wherein the housing includes a motor mounting portion provided to mount the motor thereto.

6. The air conditioner as claimed in claim 5, wherein the inlet flow path guide includes a support mounted to the motor mounting portion, and the at least one vane is provided to the support.

7. The air conditioner as claimed in claim 6, wherein the motor mounting portion includes a plurality of bars spaced at fixed intervals, and the support is fixedly secured to the plurality of bars such that the plurality of vanes is positioned in a radial direction of the fan.

8. The air conditioner as claimed in claim 5, wherein the inlet flow path guide includes a hub mounted to a lower portion of the motor, and the plurality of vanes is provided on an outside circumference of the hub in a circumferential direction of the fan.

9. An air conditioner comprising:

a housing having an air inlet and an air outlet;

a compressor provided in the housing;

a heat exchanger provided in the housing;

a fan that discharges air introduced through the air inlet out through the air outlet;

a motor mounted in the housing to rotate the fan; and an outlet flow path guide that provides a velocity component to the air being discharged from the fan in a direction opposite to a direction of a rotational velocity component of the air produced by rotation of the fan.

10. The air conditioner as claimed in claim 9, wherein the outlet flow path guide includes a plurality of vanes.

11. The air conditioner as claimed in claim 10, wherein at least one vane of the plurality of vanes is tilted in a rotation direction of the fan.

12. The air conditioner as claimed in claim 10, wherein the plurality of vanes is tilted in a direction opposite to a tilt of a blade of the fan.

13. The air conditioner as claimed in claim 10, wherein the at least one vane has a shape of a streamline, a straight line, or a combination of the streamline and the straight line.

14. The air conditioner as claimed in claim 10, wherein the at least one vane has an inlet edge with a slope angle from an axis of the fan formed larger than a slope angle of an outlet edge thereof.

15. The air conditioner as claimed in claim 9, further including an outlet grill mounted to an air outlet of the housing, wherein the outlet flow path guide is arranged in a space between the outlet grill and the fan.

16. The air conditioner as claimed in claim 15, wherein the outlet flow path guide includes:

a mounting member, and a plurality of vanes provided to an outside circumference of the mounting member tilted in a rotation direction of the fan.

17. The air conditioner as claimed in claim 9, further including an outlet grill mounted to an air outlet of the housing, wherein the outlet flow path guide is formed as one unit with the outlet grill.

18. The air conditioner as claimed in claim 17, wherein the outlet grill includes a plurality of ribs extended in a radial direction of the fan, and the rib is tilted in a rotation direction of the fan.

* * * * *